US006327878B1

(12) United States Patent
Levenson

(10) Patent No.: US 6,327,878 B1
(45) Date of Patent: Dec. 11, 2001

(54) PORTABLE SECURITY DEVICE

(76) Inventor: Alvin S. Levenson, 17205 Falls Rd., Upperco, MD (US) 21155

( * ) Notice: Subject to any disclaimer, the term of this patent is extended or adjusted under 35 U.S.C. 154(b) by 0 days.

(21) Appl. No.: 09/389,602

(22) Filed: Sep. 3, 1999

(51) Int. Cl.[7] ..... E05B 73/00
(52) U.S. Cl. ..... 70/14; 70/2; 70/416; 292/288
(58) Field of Search ..... 70/416, 14, 2, 70/101; 292/288, 289, 290, 292, 297, 298

(56) References Cited

U.S. PATENT DOCUMENTS

| | | | | |
|---|---|---|---|---|
| 4,169,619 | * | 10/1979 | McCracken | 292/290 |
| 4,896,518 | * | 1/1990 | Appelgren | 70/14 |
| 5,480,200 | * | 1/1996 | Aintablian | 292/288 |
| 5,667,262 | * | 9/1997 | Planchon | 292/288 |
| 5,934,111 | * | 8/1999 | Hernandez | 70/2 |
| 5,934,113 | * | 8/1999 | Loughlin | 70/2 |

* cited by examiner

*Primary Examiner*—Richard M. Camby

(74) *Attorney, Agent, or Firm*—Richard L. Huff

(57) ABSTRACT

A portable security device which can be easily mounted on inwardly swinging doors. the device is made up of a inner plate which has first and second panels, an outer plate which has first and second panels, a hinge connecting, and permitting rotation between, the second panel of the inner plate and the first panel of the outer plate, a securing attachment, and a holding mechanism. The first and second panels of the inner plate are perpendicular to each other. The first panel of the inner plate fits against the strike plate and has a lock tab which fits into the bolt hole in a strike plate. The second panel of the inner plate fits against side edge of the door jamb and contains a horizontal protrusion which contains an opening. The first panel of the outer plate contains a horizontal slot which will fit over the protrusion when the device is in place, thus exposing the opening of the protrusion. The second panel of the outer plate is perpendicular to the first panel. When the device is in place, the end of the second panel will abut against the closed door and prevent the door from opening, A holding mechanism, held by the securing attachment, fits into the exposed opening in the protrusion. The holding mechanism contains a lock hole which is suitable for holding a padlock to secure the device. Thus mounted, the device will prevent the door from opening. The device may be easily mounted and removed.

7 Claims, 2 Drawing Sheets

PORTABLE SECURITY DEVICE

BACKGROUND OF THE INVENTION

1. Field of the Invention

This invention is directed to a portable security device which fits a variety of sizes of doors and is easily mounted to, and removed from, door jambs without the necessity of hardware such as screws or bolts.

2. Description of the Related Art

It is desirable and important to keep dangerous items, such as guns, and valuables, such as money and jewelry, in safe places which are inaccessible to children and burglars. Curious children will search throughout the house to find hidden dangerous items and burglars are adept at finding hidden valuables. Therefore, it is wise if these items are kept behind locked doors which cannot be opened by children or burglars, but can be easily opened by the rightful owner. The prior art is familiar with hasp locks for this purpose. However these locks require permanent attachment to door jambs with screws or bolts and therefore lack the convenience of ease of selecting which door is to be secured.

SUMMARY OF THE INVENTION

The object of the present invention is to provide a device which is easy to install, will lock a door securely, and can be easily removed and moved to another door without the use of tools. The device of the present invention is simple to make and use, versatile, and effective. The device contains two plates which are hinged together. For purposes of easy identification, the plate which fits onto the door jamb is termed the inner plate, while the plate which covers the inner plate and fits toward the user is called the outer plate. Each plate is made up of two panels which are perpendicular to each other. The first panel of the inner plate fits on the strike plate of a door jamb and contain a lock tab which fits into the bolt hole in the strike plate. The second panel of the inner plate contains a horizontal protrusion which contains an opening for a holding mechanism. The first panel of the outer plate and the second panel of the inner plate are rotatably secured by a hinge. The first panel of the outer plate contains a horizontal slot to allow for passage of the horizontal protrusion of the second panel of the inner plate. The first panel of the outer plate also contains a hole for securing a chain for holding the holding mechanism. The second panel of the outer plate is so formed as to fit between the juncture of the first and second panels and the closed door. When the device is fitted into place on the strike plate of a door jamb and the device is in the closed position, the horizontal protrusion fits through the horizontal slot of the first panel of the outer plate. The opening in the horizontal protrusion for receiving the holding mechanism is thus exposed. The holding mechanism, which is similar in appearance to a key, fits through the opening in the horizontal protrusion. A lock hole in the holding mechanism receives a padlock, securing the holding mechanism in place.

DESCRIPTION OF THE PREFERRED EMBODIMENTS

Figure 1:
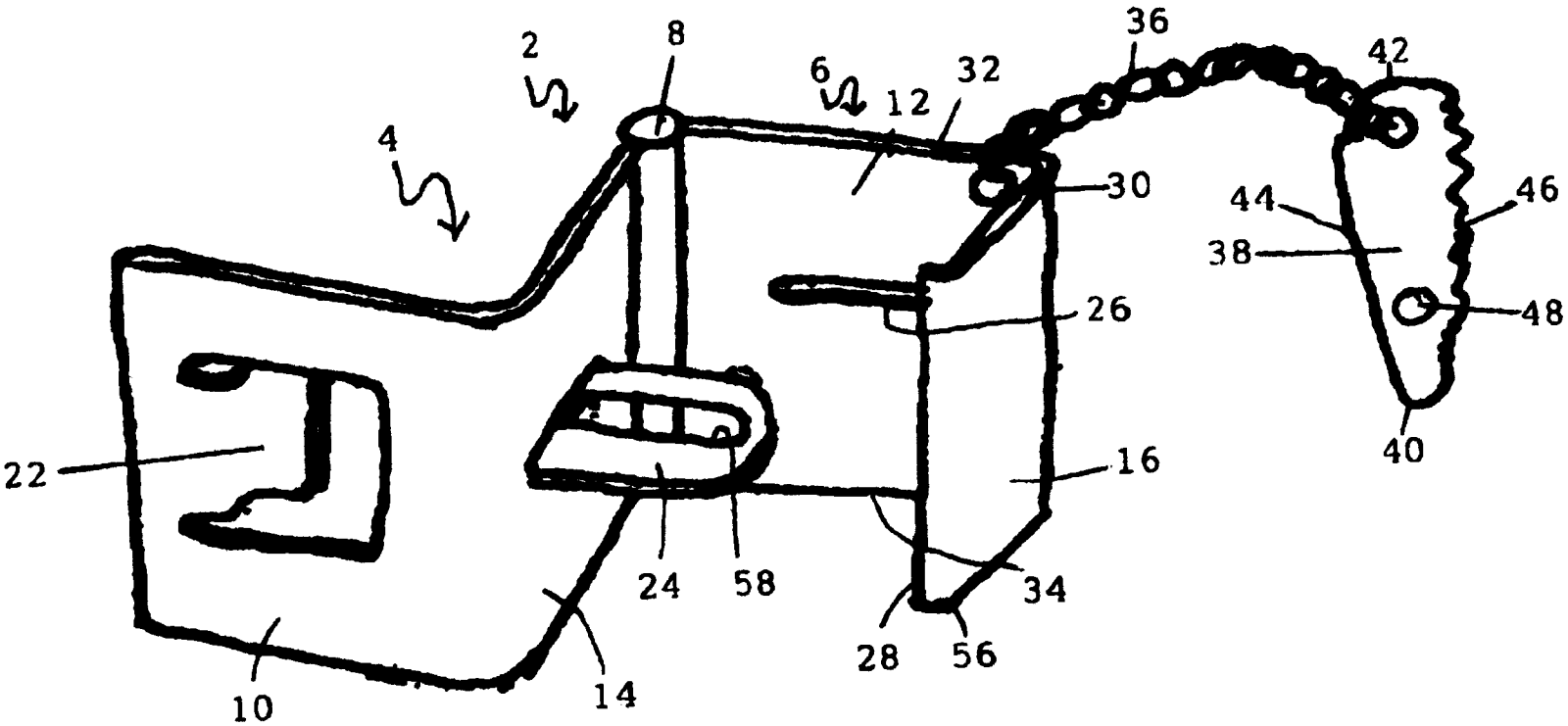
FIG. 1 is an elevational perspective view showing the device of the present invention.
Figure 2:
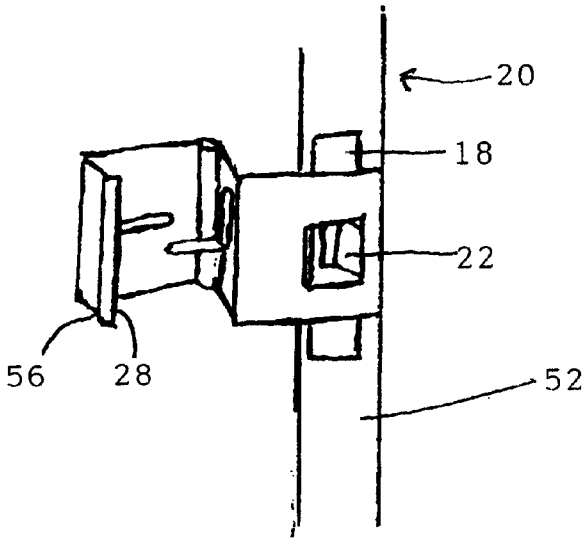
FIG. 2 is an elevational perspective view showing the device of the invention in an open position mounted on a strike plate of a door jamb.
Figure 3:
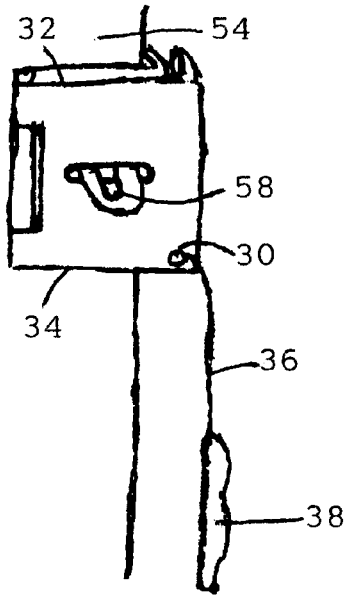
FIG. 3 is an elevational perspective view showing the device of the invention in a closed position mounted on a door jamb.
Figure 4:
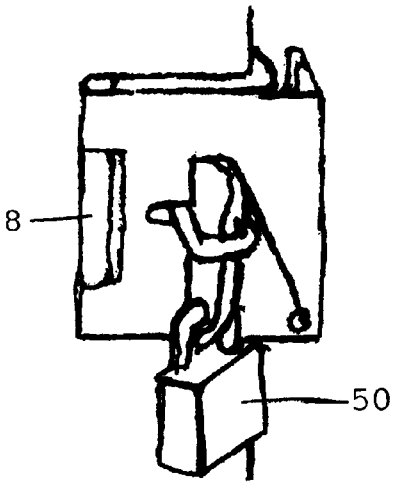
FIG. 4 is an elevational perspective view showing the device of the invention in a closed and locked position mounted on a door jamb.

The invention will now be described with reference to FIGS. 1–4. Like reference numerals refer to like elements throughout the description.

The portable security device 2 of the present invention is made up of an inner plate 4 and an outer plate 6 held in pivotal connection by a hinge 8. Each of the two plates 4 6 has a first panel 10 12 and a second panel 14 16.

The first panel 10 of the inner plate 4 fits against a strike plate 18 on the inside edge a door jamb 20. This first panel 10 contains a lock tab 22 which is the result of milling the first panel 10. The lock tab 22 is of such a size and shape as to fit into the bolt hole of the strike plate and helps to keep the device 2 in place.

The second panel 14 of the inner plate 4 is perpendicular to the first panel 10. The second panel 14 fits along the side of the door jamb 20 when the device 2 is in place. The second panel 14 contains a horseshoe-shaped horizontal protrusion 24 in the center thereof, which protrusion is directed away from the door jamb 20 when the device is in place.

The outer plate 6 is of such a size and shape as to fit over the inner plate 4, receive the horizontal protrusion 24 and to rest against a closed door when the device 2 is in place and in the closed position. A first panel 12 of the outer plate 6 is rotatably connected to the second panel 14 of the inner plate 4 with a hinge 8. Preferably, the hinge 8 is of the same type as a door hinge. The first panel 12 of the outer plate 6 contains a horizontal slot 26 which is of such a size as to freely receive the horizontal protrusion 24. Thus, when the device 2 is in the closed position, the first panel 12 of the outer plate 6 will cover the second panel 14 of the inner plate 4 and the horizontal protrusion 24 will fit through the horizontal slot 26.

The second panel 16 of the outer plate 6 is perpendicular to the first panel 12. When the device 2 is in the closed position, the first panel 12 of the outer plate 6 will cover and be close to the second panel 14 of the inner plate 4. Preferably, the second panel 16 of the outer plate 6 contains a lip 28 which abuts with the door to protect it from scarring.

The first panel 12 of the outer plate 6 contains a hole 30, preferably near the upper 32 or lower edge 34 thereof. This hole 30 holds one end of a chain 36 or other securing attachment. On the other end of the chain 36, there is a holding mechanism 38 which is tapered so that it is smaller at the bottom 40 and larger at the top 42. This holding mechanism 38 also has one smooth edge 44 and one roughened edge 46. Toward the bottom 40 of the holding mechanism 38, there is a lock hole 48 for receiving a padlock 50. The padlock 50 may be a conventional key or combination lock.

The operation of the device 2 will now be explained.

To secure a door so that it cannot be opened by a child or burglar, the owner simply places the lock tab 22 into the bolt hole in the striker plate 18 of the door jamb 20. This places the first panel 10 of the inner plate 4 on the inside edge 52 of the door jamb 20 and the second panel 14 of the inner plate 4 along the side edge 54 of the door jamb 20. The door is then shut so that the door bolt abuts with the lock tab 22 and holds it in place. The outer plate 6 is next moved to cover the inner plate 4 and the horizontal protrusion 24 passes through the horizontal slot 26. The edge 56, or lip 28, of the second panel 16 of the outer plate 6 will rest against the door. The holding mechanism 38 is inserted into the exposed opening 58 in the horizontal protrusion 24 and a padlock 50 is inserted into the lock hole 48 of the holding mechanism 38 and locked.

It can be seen that by having a tapered holding mechanism 38, the device 2 of this invention can be used on door jambs 20 of various sizes. The device 2 of the present invention is thus capable of being put into place and securely locking a door without the use of tools. Removal of the device is impossible or extremely difficult without the key or combination to the padlock 50. To remove the device 2, it is merely necessary to unlock and remove the padlock 50, rotate the outer plate 6 away from the door, open the door, and remove the lock tab 22 from the bolt hole.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A portable security device which comprises:

A) an inner plate comprising a first panel and a second panel, which panels are perpendicular to each other,
   i) said first panel containing a lock tab for fitting into a bolt hole in a strike plate of a door jamb,
   ii) said second panel having a horizontal protrusion containing an opening, B) an outer plate comprising a first panel and a second panel, which panels are perpendicular to each other,
   i) said first panel being rotatably connected to the second panel of the inner plate and containing a horizontal slot for receiving the horizontal protrusion,
   ii) said second panel having an end which will abut against a closed door when the device is in place, and C) a tapered holding mechanism having a top and bottom and being larger at the top and smaller at the bottom, said holding mechanism containing a lock hole for receiving a padlock.

2. The device of claim 1, wherein the holding mechanism has a smooth edge which, when the device is in place, will abut with the first panel of the outer plate and a roughened edge which, when the device is in place, abut with the exposed opening in the protrusion.

3. The device of claim 1, wherein the second panel of the inner plate and the first panel of the outer plate are rotatably connected by means of a hinge.

4. The device of claim 1, wherein the tapered holding mechanism is secured to the outer plate by means of a securing attachment.

5. The device of claim 4, wherein the securing attachment is a chain.

6. The device of claim 1, wherein the second panel of the outer plate contains a lip which, when the device is in place, abuts against a closed door.

7. A method of securing an inwardly opening door having a door bolt, which door is in a door jamb having an inside edge, a side edge, and a strike plate, which strike plate has a bolt hole, comprising:

A) placing the lock tab of the device of claim 1 into the bolt hole in the strike plate of a door jamb, thus placing the first panel of the inner plate on the inside edge of the door jamb and the second panel of the inner plate on the side edge of the door jamb;

B) shutting the door to bring the door bolt into abutment with the lock tab of the device;

C) rotating the outer plate about the inner plate so that i) the outer plate covers the inner plate ii) the horizontal protrusion of the inner plate passes through the horizontal slot of the outer plate thus exposing the hole of the protrusion beyond the outer plate, and iii) the edge of the second panel of the outer plate abuts with the door, D) inserting the holding mechanism into the exposed opening in the horizontal protrusion until the holding mechanism is snug; and E) inserting a padlock into the lock hole of the holding mechanism and locking the padlock.

* * * * *